US006427247B1

(12) United States Patent
Suk

(10) Patent No.: US 6,427,247 B1
(45) Date of Patent: Aug. 6, 2002

(54) STABILIZED SIZED GOLF GLOVE

(76) Inventor: Young J. Suk, 32 Garvies Point Rd., Glen Cove, NY (US) 11542

( * ) Notice: Subject to any disclaimer, the term of this patent is extended or adjusted under 35 U.S.C. 154(b) by 0 days.

(21) Appl. No.: 09/954,125

(22) Filed: Sep. 18, 2001

(51) Int. Cl.[7] ..... A41D 19/00
(52) U.S. Cl. ..... 2/161.2; 2/161.1; 2/159
(58) Field of Search ..... 2/16, 20, 158, 2/159, 160, 161.1, 161.2, 161.3, 161.5, 161.6, 166, 167, 169

(56) References Cited

U.S. PATENT DOCUMENTS 5,125,115 A * 6/1992 Lincoln ..... 2/159
5,309,573 A * 5/1994 Solar et al. ..... 2/161.4
5,515,547 A * 5/1996 Middleton ..... 2/158
5,708,979 A * 1/1998 Redwood et al. ..... 2/161.1
6,035,443 A * 3/2000 Green ..... 2/161.2
6,154,885 A * 12/2000 Kobayashi et al. ..... 2/161.3

* cited by examiner

*Primary Examiner*—John J. Calvert
*Assistant Examiner*—Gary L. Welch
(74) *Attorney, Agent, or Firm*—Myron Amer P.C.

(57) ABSTRACT

A golf glove, preferably of leather construction material, and including a closed loop of a horizontally oriented strip of elastic at a midpoint of its length as measured from the opening into the glove and its fingertips, which length determines its size, i.e. small, medium or large, during the hiking of the glove onto the user's hand as occurs after its removal prior to putting and prior to tee off, the stretch occasioned by the hiking is localized in the elastic strip and obviates the leather stretching out of shape or size.

2 Claims, 2 Drawing Sheets

STABILIZED SIZED GOLF GLOVE

The present invention relates generally to improvements for golf gloves, the improvements more particularly being directed to stabilizing the shape and size of the golf glove.

Background of the Invention

1. Field of the Invention

It is common practice in constructing golf gloves of leather, the construction material of choice, to provide a smooth, wrinkle-free interface between the palm of the glove and the golf club handle as well as to establish a friction grip, in some glove portions and in other glove portions to use elastomeric construction material, the latter at glove locations where the fingers flex in the gripping of the golf club handle. Thus, in U.S. Pat. No. 5,708,979 for "Glove With Elastic Back" issued to Redwood et al. on Jan. 20, 1998, elastic is used along the back of leather finger enclosures at least over one knuckle of each finger to allow stretching when the finger is bent.

Similarly, in U.S. Pat. No. 6,154,885 for "Golf Gloves" issued to Kobayashi et al. on Dec. 5, 2000 to promote proper fit, most of the back part and palm part of the glove body is formed from a stretch material.

While these exemplary golf gloves fit properly, it is known from common experience that long before they show signs of abuse of wear, they are stretched out of size and shape and on this account must be replaced. This is undoubtedly due to excessive, rather than judicious use of elastic glove components, in that as between elastic and leather, the latter is the more stable as to size and shape.

SUMMARY OF THE INVENTION

Broadly, it is an object of the present invention to provide a combination leather and elastic constituted golf glove overcoming the foregoing and other shortcomings of the prior art.

More particularly, it is an object to complement, not replace, the leather of the golf glove and, in so doing, impart a stabilized size and shape to the glove by its leather construction material, and obviate the loss of this stability by the judicious use of elastic construction material, all as will be better understood as the description proceeds.

Underlying the present invention is the recognition that a golf glove is not just placed in wearing service, so-to-speak "once" during a round of golf, namely at the beginning of the round and then removed after the round, but that at the end of each golf hole there occurs a process of hiking the glove onto the golfer's hand and, unless neutralized, the forces applied to the glove could distort its shape and size.

The description of the invention which follows, together with the accompanying drawings should not be construed as limiting the invention to the example shown and described, because those skilled in the art to which this invention appertains will be able to devise other forms thereof within the ambit of the appended claims.

DESCRIPTION OF THE PREFERRED EMBODIMENT

Figure 2:
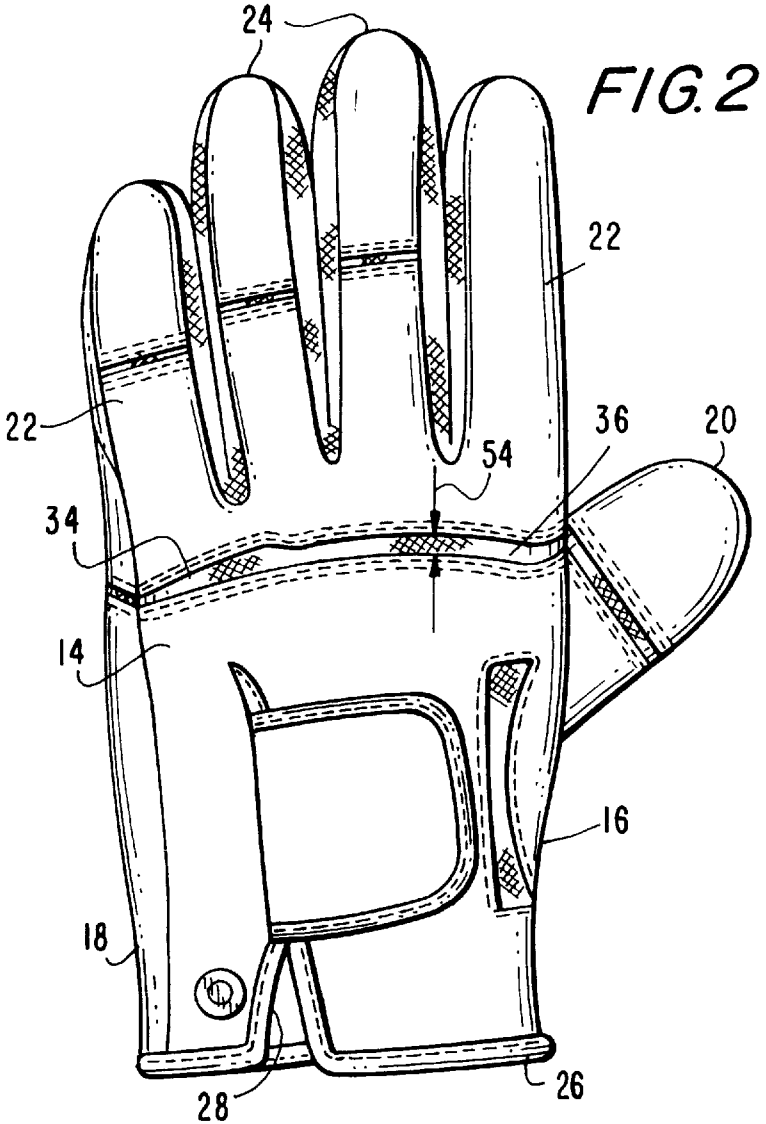
FIG. 2 is an elevational view of the rear of the golf glove.
Figure 1:
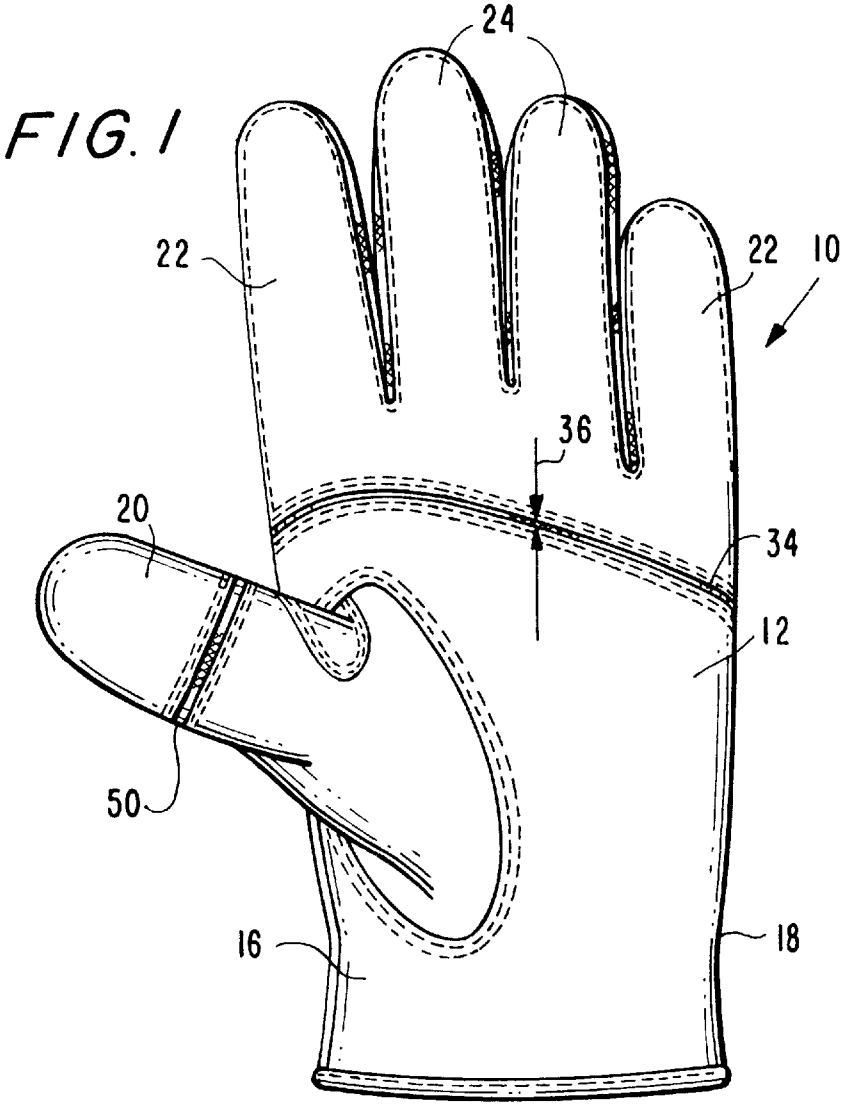
FIG. 1 is an elevational view of a front of a golf glove according to the present invention.

The drawing figures illustrate a glove, generally designated 10, intended for use in the playing of a round of golf which follows the current practice of using thin, but durable, leather construction material forming a front or palm-covering body 12 and a rear or back-of-the-hand covering body 14, joined in adjacent or superposed relation to each other by opposite side seams 16 and 18 sized to fit on selected hand sizes, usually designated small, medium and large. The patterns for the front and rear bodies 12, 14 include thumb 20, and finger enclosures, individually and collectively designated 22, which cover the golfer's thumb and fingers and terminate at a distal end of the glove 10 in fingertip enclosures, individually and collectively designated 24.

A fitting opening bounded by a piping-enclosed rear edge 26 finishing the body front 12 and rear 14 opens into the glove compartment 28 and, in the sizing of the glove 10, it is the edge 26 and fingertips 24 which delimits the length size 30 of the glove 10 and determines whether it is small, medium or large.

It is known from common experience that it is the practice of many golfers to remove a golf glove that is worn from "tee off to green" and thus during play on the fairway of the golf course, preparatory to putting on the putting "green", in order to experience a more sensitive-to-the-touch feel of the handle of the putter in the golfer's handgrip in the belief that this improves the golfer's putting.

It is also known from common experience that after several rounds of golf, different for different golfers but, occurring nevertheless before the leather construction material of the glove shows worn-through areas because of any abuse of wear, that the glove length size 30 undesirably increases or stretches beyond its starting size. The length added by the stretching contributes to wrinkling and necessitates smoothing out when the glove is worn, since otherwise it is a source of discomfort.

Underlying the present invention is the recognition of a synergism between the demands of play as practiced by most golfers and the stretching out of shape shortcoming of a leather golf glove, and obviating the latter. More particularly, the golf glove 10 is not just in wearing service, so-to-speak "once" during a round of golf, namely at the beginning of the round and then removed after the round, but undergoes being worn eighteen times during a golf round, namely at the beginning of the first golf hole, and then at the beginning of the second and at the beginning of each of the second through the next seventeen holes. Thus, the golf glove 10 removed from a golfer's hand is repetitiously restored in place, typically eighteen times during each round of golf.

Figure 4:
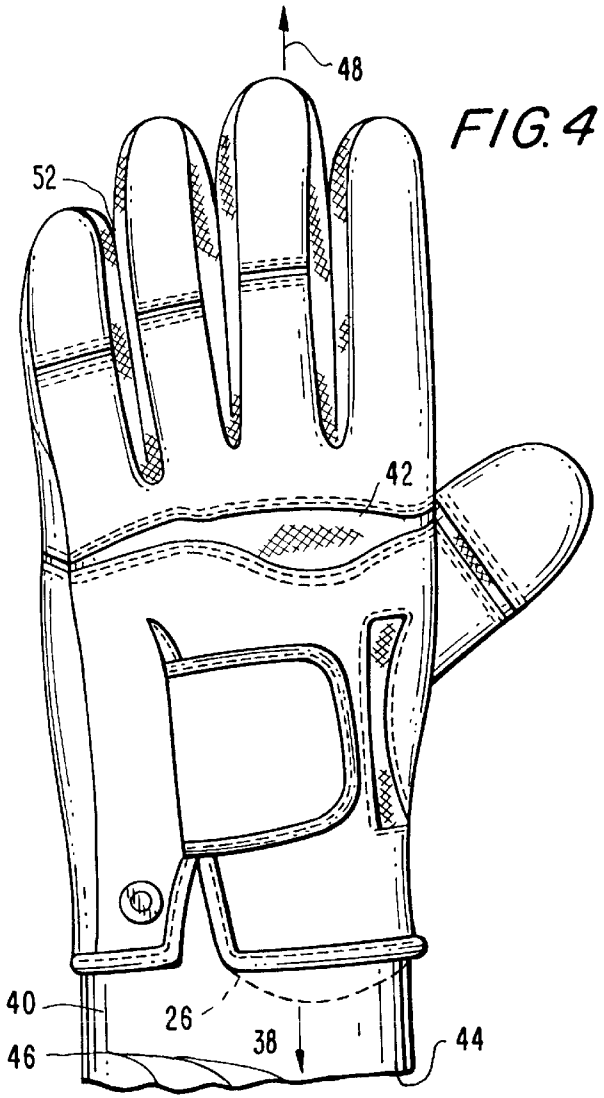
FIGS. 3 and 4 are views similar respectively to FIGS. 1 and 2 but illustrating the golf glove being prepared for use.
Figure 3:
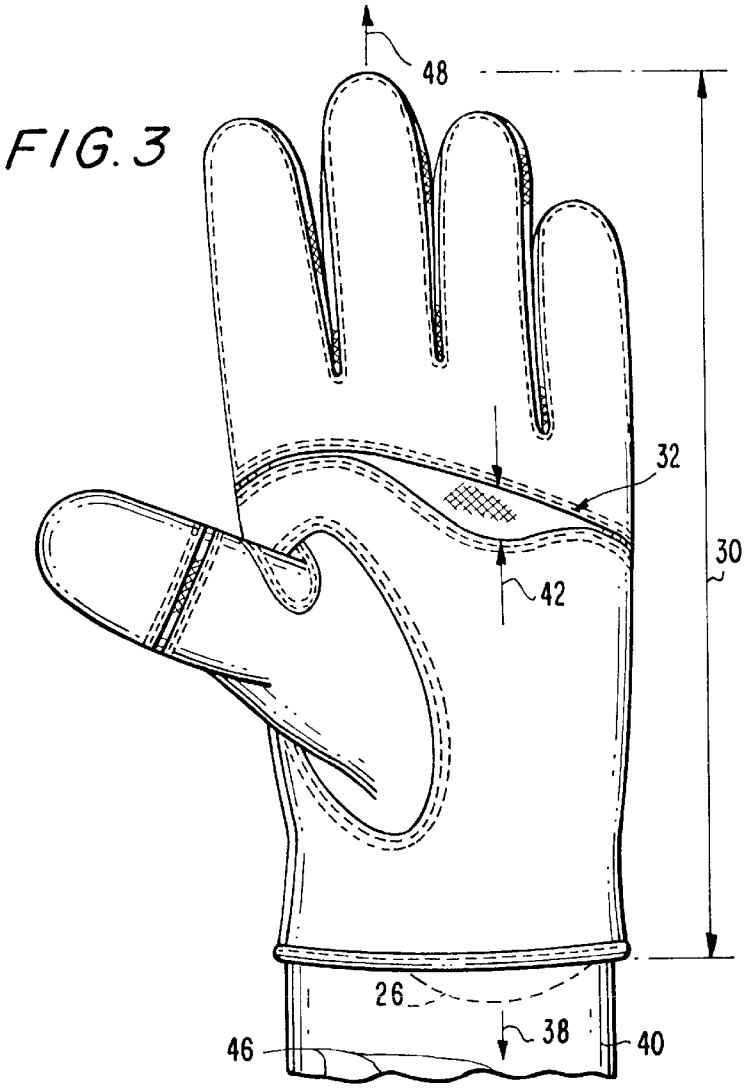

Reference should be made to FIGS. 3 and 4 which best illustrate how the construction of the golf glove 10 according to the present invention accommodates to the repetitious replacement of the glove on the golfer's hand without adverse consequence to the shape of the glove. Glove 10, in addition to its leather construction material at locations coincident with its front, rear and fingers 12, 14 and 22, includes adjacently below the openings into the finger stalls or enclosures 22, and approximately centrally of its length size 30, as noted at 32, a closed loop of a transverse or approximately horizontally oriented strip 34 of stretch construction material, such as that sold as "spandex" and understood to be made of or containing a polyurethane fiber with elastic properties, which in its unstretched condition is of a nominal width 36. In response to a lengthwise directed force 38, applied during the restoring of the glove 10 on the golfer's hand 40, the width of the strip 34 increases in size to a width 42 and, in so doing, the force 38 that would have a tendency to stretch the leather of the glove out of shape, is localized in the strip 34 and thus neutralized. Each time that the force 38 is removed, the urgency of the construction material of the strip 34 restores it to its unstretched width 36 so that the process of hiking the glove 10 onto the golfer's hand 40 can be repeated, until completed.

The closed loop nature of the strip 34 is used to advantage to achieve neutralization of the applied forces 38 not only at the location 44 along the rear edge 26 illustrated, but also at other locations, such as those individually and collectively designated 46, as might be selected by the golfer, since typically the movement of the glove 10 over the golfer's inserted hand 40 is incremental, because of frictional resistance at the interface of the interior surface of the glove and the golfer's hand 40, and requires repetitiously pulling at locations 46, with the palm up and then with the palm down, until the golfer's hand 40 is fully inserted in the glove.

Although not shown, but which should be fully understood from common experience as well as from the description of the glove-restoring process of FIGS. 3 and 4, removal of the glove 10 is typically practiced by gripping and pulling on the glove fingertips 24 in a direction 38 opposite to the direction 48, and this also will neutralize the applied forces for removal by localizing stretching in the elastic strip 34.

For completeness sake, it is noted that for improved fitting of the glove 10 on the golfer's hand, but not focused on stabilizing the shape and size 30 of the glove 10 as is the focus of the strip 34, it is recommended that the glove 10 include stretch construction material in its thumb enclosure 20, as at 50, and between the finger enclosures 22, as at 52.

In a preferred embodiment, the length 30 of a medium-sized glove 10 is eight and one/quarter inches as measured from edge 26 to the fingertip 24 of the middle finger, the width of strip 34 in the palm-covering body 12 one sixteenth of an inch, and the strip width 54 in the back-of-the-hand body 14 variable, starting with a maximum width beneath the pointing and middle finger of one quarter of an inch, but these dimensions can vary somewhat so long as they localize stretching without prohibiting the ability to pull the glove in covering relation over the golfer's hand and/or fail to provide a good grip at the interface of the palm of the glove and the handle of the golf club being used.

While leather is the construction material of choice, a plastic that provides a good grip and is breathable and otherwise comfortable to use under game conditions as previously described, will be understood to be within the contemplated scope of the present invention.

While the golf glove herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A glove for golfing for use in playing a round of golf during which said glove is worn from tee to green and preparatory to putting subjected to being repetitiously removed from and restored in place on a golfers hand, said glove comprising a hand-covering body of leather construction material delimiting a selected length size as measured from an edge bounding a fitting opening into a proximal end of said body to fingertip enclosures on a distal end of said body, in an adjacently located area below fingers of said glove terminating in said fingertip enclosures thereof hand back-covering and hand palm-covering cooperating body portions disposed in adjacent relation to each other and centrally of said delimited length size, and in said cooperating body portions a closed loop of a horizontally oriented strip of stretch construction material adapted to expand in width in response to a pulling force exerted lengthwise of said glove at said fitting opening edge, and during said repetitious restoring in place of said glove any expansion of said glove length size is localized in said closed loop elastic strip, whereby said closed loop elastic strip contributes to obviating said glove leather construction material stretching out of said selected length size thereof.

2. A glove for golfing for use in playing a round of golf during which said glove is worn from tee to green and preparatory to putting subjected to being repetitiously removed from and restored in place on a golfer's hand, said glove comprising a hand-covering body of selected construction material delimiting a selected length size as measured from an edge bounding a fitting opening into a proximal end of said body to fingertip enclosures on a distal end of said body, in an adjacently located area below fingers of said glove terminating in said fingertip enclosures thereof hand back-covering and hand palm-covering cooperating body portions disposed in adjacent relation to each other and centrally of said delimited length size, and in said cooperating body portions a closed loop of a horizontally oriented strip of stretch construction material adapted to expand in width in response to a pulling force exerted lengthwise of said glove at said fitting opening edge, and during said repetitious restoring in place of said glove any expansion of said glove length size is localized in said closed loop elastic strip, whereby said closed loop elastic strip contributes to obviating said glove construction material stretching out of said selected length size thereof.

* * * * *